United States Patent [19]

Shibata

[11] Patent Number: 4,557,337

[45] Date of Patent: Dec. 10, 1985

[54] IMPACT WRENCH

[75] Inventor: Ryoichi Shibata, Habikinoshi, Japan

[73] Assignee: Katushiki Kiisha Kuken, Osaka, Japan

[21] Appl. No.: 568,561

[22] Filed: Jan. 5, 1984

Related U.S. Application Data

[63] Continuation-in-part of Ser. No. 340,669, Jan. 19, 1982, Pat. No. 4,460,049.

[30] Foreign Application Priority Data

Jan. 27, 1981 [JP] Japan ..... 56-11088

[51] Int. Cl.[4] ..... B25D 15/02

[52] U.S. Cl. ..... 173/93.5; 173/93; 173/94

[58] Field of Search ..... 173/93, 93.5, 94; 81/463, 464

[56] References Cited

U.S. PATENT DOCUMENTS 2,820,536 1/1958 Boe ..... 173/93.5
2,881,884 4/1959 Amtsberg ..... 173/93.6
2,940,566 6/1960 Conover, Jr. ..... 173/93.5
3,789,934 2/1974 Schoeps et al. ..... 173/93.5

FOREIGN PATENT DOCUMENTS 57-127678 8/1982 Japan .

*Primary Examiner*—E. R. Kazenske
*Assistant Examiner*—Willmon Fridie, Jr.
*Attorney, Agent, or Firm*—Jordan and Hamburg

[57] ABSTRACT

An impact wrench for using fastening or unfastening fasteners comprises a cylindrical rotor coupled to a motor shaft, said cylindrical rotor including a projection on its inner surface, the projection having a circumferential width and an axial length; an anvil coupled to said cylindrical rotor, the anvil including a hammer member capable of rocking therein, the hammer member being engageable with said projection; a spring-loaded pusher for urging said hammer member towards said projection, wherein a spring support slides either on a deep cam face or a shallow cam face both produced on said inner surface of the cylindrical rotor, thereby allowing said spring to become compressed or relaxed against said hammer member.

6 Claims, 8 Drawing Figures

IMPACT WRENCH

REFERENCE TO RELATED APPLICATION

This application is a continuation-in-part of application Ser. No. 340,669, filed Jan. 19, 1982 now U.S. Pat. No. 4,460,049.

BACKGROUND OF THE INVENTION

The present invention relates to an impact wrench for use in fastening or unfastening bolts or nuts. More particularly, the present invention relates to an impact wrench for such use, which includes a rotor driven by a motor thereby to cause the fasteners to be driven into the fixtures through the motion of the anvil hit by the rotor intermittently.

The known impact wrenches have a hammer portion provided by a rotor connected to a rotating shaft. While the rotor is rotated around the anvil, the hammer portion of the rotor is forced into engagement with the anvil under the action of a cam or any other similar device. The engagement of the hammer portion of the rotor occurs when the rotor rotates at a high speed, and the engagement is finished in a moment. In addition, the hammer portion is subjected to various forces while the same is in such a quick movement. Owing to these factors the fabricating of the rotor, particularly of the hammer portion, involves difficulties, and even if it is fabricated, differences in movement occur from rotor to rotor. Furthermore, as the rotor is partially abraded, it becomes difficult for the hammer portion to fall exactly on the anvil, which results in weak blows or even non-blows. This leads to incomplete fastening of fasteners.

In order to solve the problems mentioned above, the inventor has invented an improved wrench which has no hammer or hammer portion, disclosed in Japanese Laid-Open specification No. 127678/82. In the new type of wrench an anvil is placed inside the cylindrical rotor, such that it is ready to be hit by a projection provided on the inside surface of the rotor while to rotor rotates. The anvil is subjected to a relatively large spring load, against which the anvil is positioned, until the same comes into engagement with the side of the projection. Because of this spring-loaded situation, a frictional loss tends to occur between the anvil and the inside surface of the rotor, which retards its speed. As a result, the impact expected to occur therebetween becomes weak. To improve it a larger torque will be required, which gives a detrimentally large reaction to the operator. In addition, at the moment when the anvil is about to come into engagement with the projection, the anvil is likely to displace wholly or partially from the projection due to the action of the spring. This leads to failure to hit or incomplete hitting.

OBJECTS AND SUMMARY OF THE INVENTION

The present invention is directed toward solving the problems pointed out with respect to the known impact wrenches, and has for its object to provide an improved impact wrench having an improved arrangement of adjusting the spring loads to be acted on the anvil member, thereby ensuring that a constantly regular impacts of a large strength are transmitted to the anvil.

Another object of the present invention is to provide an improved impact wrench capable of producing impacts without giving detrimental shocks to the operator's hands.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided an impact wrench, which comprises:

a cylindrical rotor coupled to a motor shaft, said cylindrical rotor including a projection on its inner surface, the projection having a circumferential width and an axial length;

an avil coupled to said cylindrical rotor, the anvil including a hammer member capable of rocking therein, the hammer member being engageable with said projection; and a spring-loaded pusher for urging said hammer member towards said projection, wherein a spring support slides either on a deep cam face or a shallow cam face both produced on said inner surface of the cylindrical rotor, thereby allowing said spring to become compressed or relaxed against said hammer member.

DETAILED DESCRIPTION OF THE INVENTION

The impact wrench includes a casing 1 with a handle 2 and a trigger 3. A compressed air is introduced in the casing 1 through an inlet (not shown) in the known manner. With the supply of a compressed air, an air motor 4 is rotated at a high speed in a clockwise or a counter-clockwise direction by operating the trigger 3 and an adjusting valve (not shown).

Figure 3:
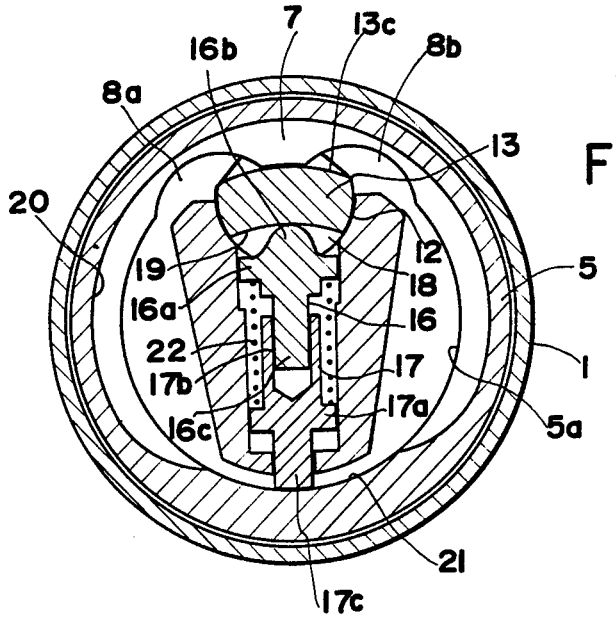
FIG. 3 is a cross-sectional front view taken along the B—B line in FIG. 1.

The air motor 4 has a rotary shaft 6 which has a cylindrical rotor 5 integrally jointed thereto by means of splines. The cylindrical rotor 5 has a circular inner surface 5*a*, on which a projection 7 is radially provided. The projection 7 has a circumferential width, and an axial length. The projection 7 has circular recesses 8*a*, 8*b* at its opposite sides, as best shown in FIG. 3. The reference numeral 5*b* designates a tail portion of the cylindrical rotor 5.

Figure 1:
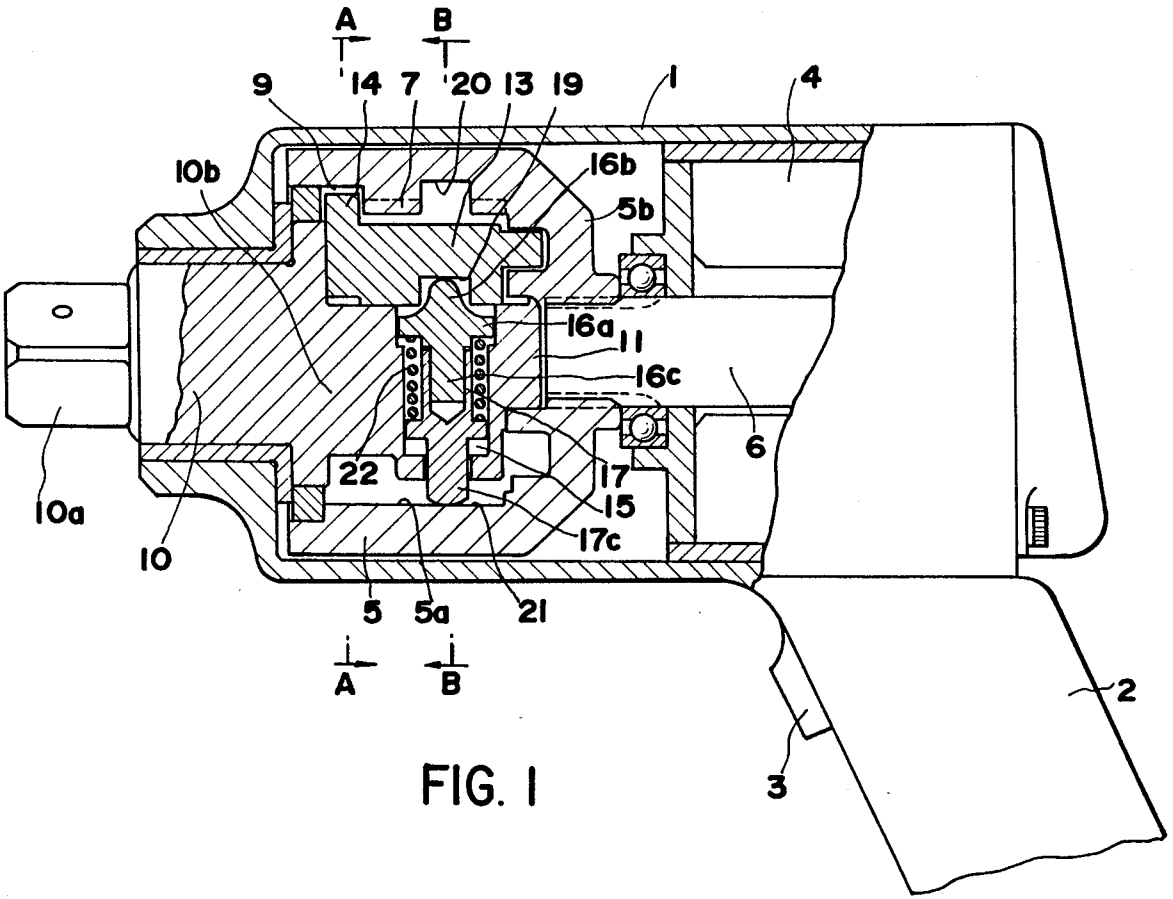
FIG. 1 is a vertical cross-section through an impact wrench embodying the present invention.

The reference numeral 9 designates a guide groove produced in the projection 7, which connects between the recesses 8*a* and 8*b* at their forward sides (in FIG. 1).

Figure 2:
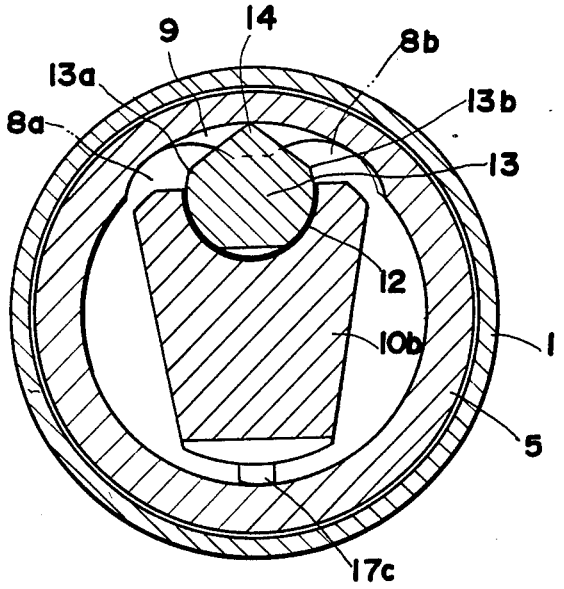
FIG. 2 is a cross-sectional front view taken along the A—A line in FIG. 1.

An anvil 10 is rotatively provided in the casing 1. The anvil 10 has a head 10*a* and a tail portion 11, which is fitted in the tail portion 5*b* of the cylindrical rotor 5. The head 10*a* is made so as to be fixed to a socket (not shown) for a bolt or a nut. The anvil 10 has a body portion 10*b* having a larger diameter, on which a groove 12 of semi-circle in cross-section is axially produced. A hammer member 13 is rotatively located in the groove 12 as best shown in FIG. 2.

Figure 5:
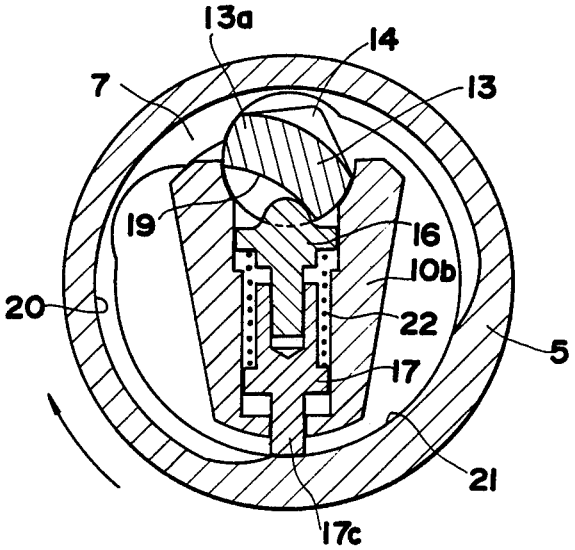

The hammer member 13 is a semi-circular rod, having the same radius of curvature as that of the circular recesses 8*a*, 8*b*, and at its circular surface it is in contact with the inner surface of the groove 12. The hammer member 13 has shoulder edges 13*a*, 13*b* at its opposite sides, and an outer surface 13*c*. It is arranged that when a line connecting transversely between the shoulder edges 13*a* and 13*b* is oriented perpendicular to a radial axis of the cylindrical rotor 5, the outer surface 13*c* is located inside the projection 7. The hammer member 13 is additionally provided with a projection 14 at its forward end, which is adapted to pass through the guide groove 9. After the projection 14 passes through the guide groove 9, its top portion and either of the shoulder edges 13*a* or 13*b* come into contact with the inner surface 5*a*, thereby forcing the hammer member 13 to tilt. When it is tilted, the shoulder edge 13*a* or 13*b* comes into engagement with either side of the projection 7 as shown in FIG. 5.

The reference numeral 15 designates a bore produced in the bottom of the groove 12, the bore accommodating a pusher 16 against the hammer member 13 and a support 17 for a coil spring 22.

Referring to FIG. 3, the pusher 16 is provided with a flange 16*a* which is adapted to slide on the inside surface of the bore 15, and with a pushing top 16*b*, which is kept in engagement with a curved bottom 19 the hammer member 13. The reference numeral 16*c* designates a shank portion which is slidably received in a slot axially produced in the support 17. The support 17 includes an extruding bottom 17*c*, which keeps contact with the inner surface of the cylindrical rotor 5.

The inner surface of the cylindrical rotor 5 includes a pair of continuous cam faces 20 and 21, wherein, as best shown in FIG. 3, the cam face 20 is concaved with respect to another cam face 21, which is convexed with respect to the cam face 20, hereinafter the cam face 20 being referred to as the deep cam face and the cam face 21 being referred to the shallow cam face. The shallow cam face 21 is opposed to the projection 7, and has such a circumferential length as to enable to the extruding bottom 17*c* of the support 17 to keep contact therewith in the period of time for which the hammer member 13 rotates from one side of the projection 7 to the other side thereof; actually, one shoulder edge 13*a* (or 13*b*) of the hammer member 13 comes into contact with one side of the projection 7, and as the hammer member rotates, another shoulder edge 13*b* (or 13*a*) thereof comes into contact with another side of the projection 7.

The coil spring 22 is provided between the flange 16*a* and a flange produced in the pusher 17.

Figure 4:
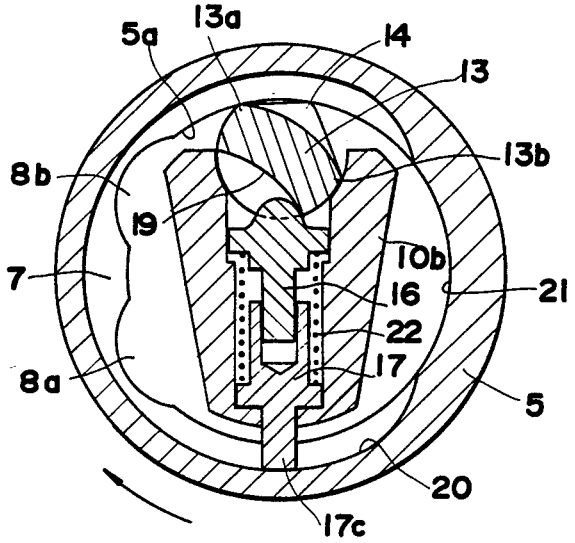
FIGS. 4 to 7 inclusive are views exemplifying the actions of the impact wrench of FIG. 1, particularly showing interrelated actions of the internal components.

In operation, after compressed air is introduced in the casing 1, the trigger 3 and the adjusting valve (not shown) are operated to rotate the air motor 4 in a clockwise direction. As the rotary shaft 6 of the motor 4 rotates, the cylindrical rotor 5 associated therewith starts to rotate in a clockwise direction with respect to the hammer member 13 as shown in FIG. 4. At this stage the hammer member 13 is tilted with its projection 14 and left-hand shoulder edge 13*a* being placed in contact with the inner surface 5*a* of the cylindrical rotor 5. As the cylindrical rotor 5 further rotates at a given angle, the left-hand shoulder edge 13*a* fits in the right-hand recess 8*b* wherein the projection 14 comes into the circular recess 8*b*. At the same time, the left-hand shoulder edge 13*a* comes into engagement with the right-hand side of the projection 7, thereby transmitting the motion of the cylindrical rotor 5 to the anvil 10 through the hammer member 13.

Before the hammer member 13 comes into engagement with the projection 7 of the cylindrical rotor 5, the extruding bottom 17*c* of the spring support 17 keeps contact with the deep cam face 20, thereby weakening the strength of the spring 22 because of an enlarged distance between the pusher 16 and the spring support 17. Thus a weaker pushing force acts on the curved bottom 19 of the hammer member 13. Under this weak spring support the hammer member 13 comes into engagement with the projection 7 of the cylindrical rotor 5 as it holds its tilting posture. As soon as the extruding bottom 17*c* comes into contact with the shallow cam face 21, the spring 22 is caused to contract upwards thereby to enable the pusher 16 to act on the curved bottom 19 of the hammer member 13. In this way the projection 14 of the hammer member 13 is pushed upwards.

The period of time for which the cylindrical rotor 5 starts to rotate and allows its projection 7 to come into engagement with the hammer member 13, is instantaneous for s single rotation of the cylindrical rotor 5.

When the projection 14 of the hammer member 13 is pushed upwards by the force of the spring 22, the projection 14 of the hammer member 13 is urged to displace from the projection 7 of the cylindrical rotor 5. The strength of the spring 22 is previously adjusted so as to be larger than the static friction between the sides of the projection 7 and of hammer member 13, but smaller than the sum of the static friction and the centrifugal force of the cylindrical rotor 5. Accordingly, the hammer member 13 is kept in engagement with the projection 7, thereby effecting the associated rotation of the cylindrical rotor 5 and the hammer member 13. In this way the anvil 10 is rotated thereby to enable bolts or nuts to rotate through the socket (not shown).

Figure 6:
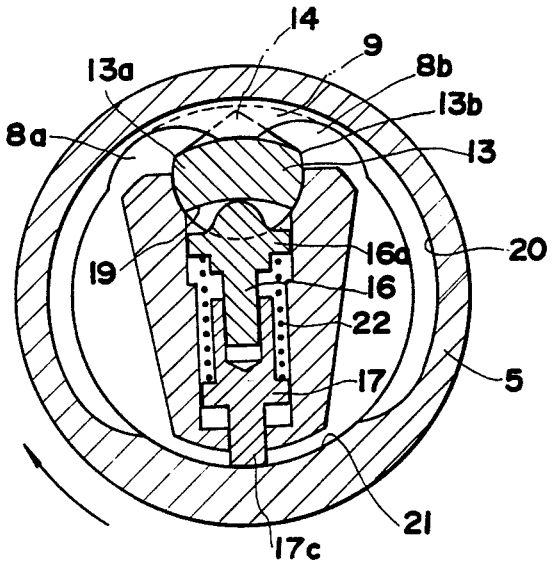
Figure 7:
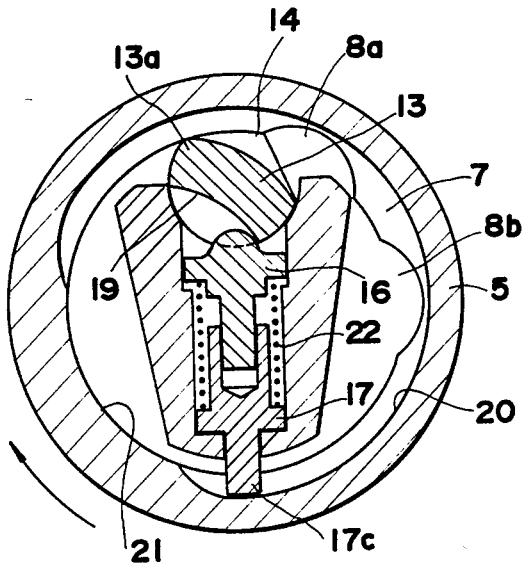

When a resisting force occurs on the bolt or nut being fastened, it is transmitted to the anvil 10. In this case, so long as the engagement of the hammer member 13 with the projection 17 continues, the anvil 10 slows down, and almost comes to a standstill. This reduces the centrifugal force acting on the hammer member 13. As evident from the aforementioned formula, the returning force of the spring 22 overcomes the static friction between the projection 7 and the hammer member 13. As a result, the hammer member 13 rotates in a counterclockwise direction, and disengages the projection 7 of the cylindrical rotor 5. As shown in FIG. 6, the cylindrical rotor 5 is in free rotation, wherein the projection 14 of the hammer member 13 passes through the guide groove 9.

After having passed through the guide groove 9, the projection 14 of the hammer member 13 enters the circular recess 8*a*, in which its top end comes into engagement with the outer end of the recess 8*a*. As a result, the hammer member 13 is again tilted. Immediately before it occurs, the extruding bottom 17*c* has been displaced on the deep cam face 20, thereby weakening the strength of the spring 22.

As a result of tilting, the shoulder edge 13*a* and the projection 7 of the hammer member 13 are placed in contact with the inner surface 5*a* of the cylindrical rotor 5, and as it is, the cylindrical rotor 5 is in free rotation until its projection 7 comes into engagement with the side of the hammer member 13.

At this stage, if a resisting torque acts on the anvil 10, which is greater strength than the torque of the motor 4, the engagement of the hammer member 13 with the projection 7 of the cylindrical rotor 5 cannot last long because the centrifugal force required to effect the engagement of those only acts instantaneously. Thus the hammer member 13 is readily disengaged from the projection 7. But after one rotation, the hammer member 13 again comes into engagement with the projection 7. As the resisting torque becomes larger, the engagement of th hammer member 13 with the projection 7 involves larger impacts. The bolt or nut is tightened under the series of impacts.

When a bolt or nut is loosened, the air motor 4 is rotated in a counterclockwise direction.

Figure 8:
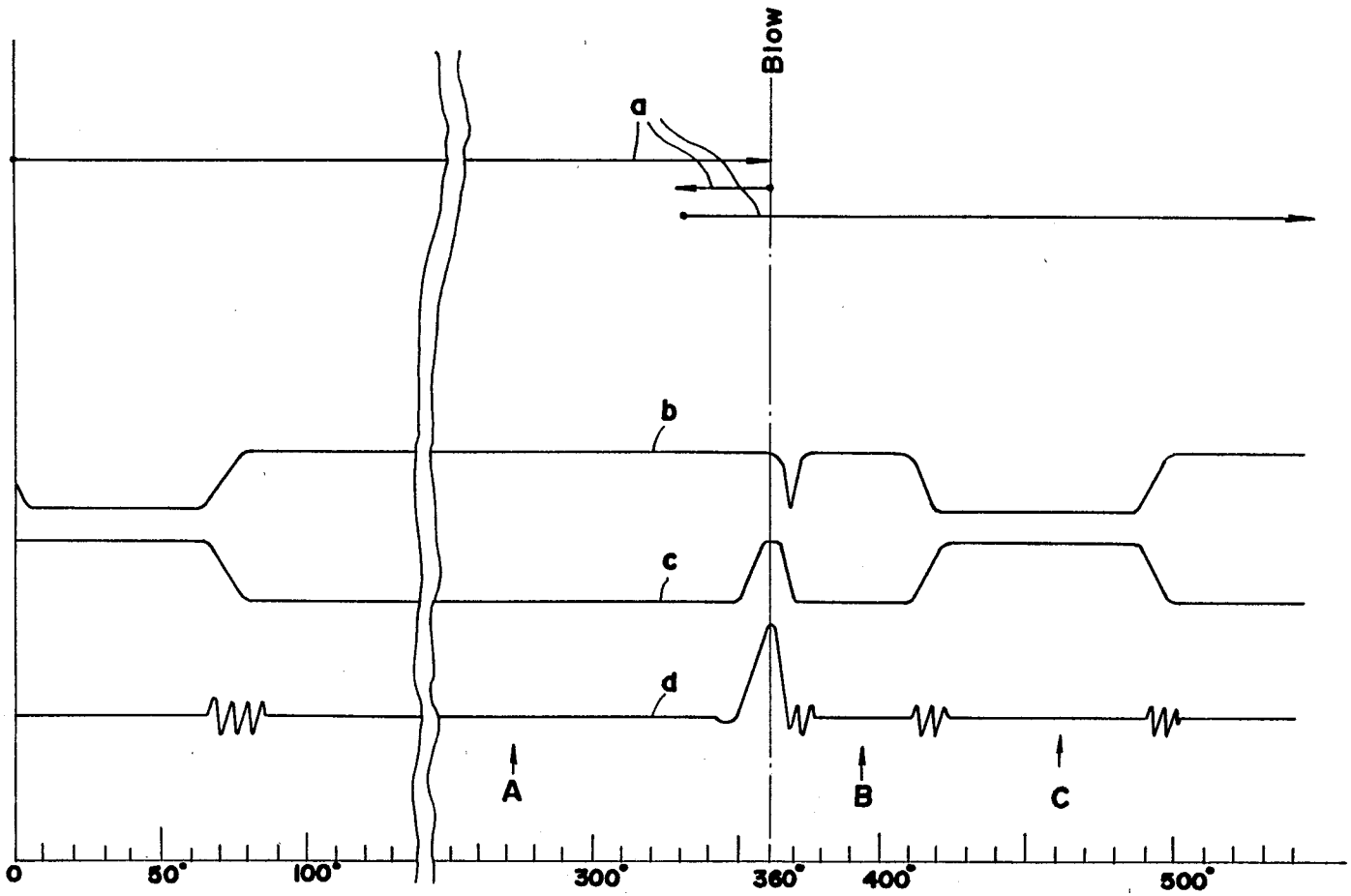
FIG. 8 is a chart showing the actions of the components.

FIG. 8 diagrammatically shows the actions of the cylindrical rotor 5, the influences given by the hammer member 13 on the spring 22, and the influences given by the cam faces 20, 21 on the rotation of the cylindrical rotor 5, which are represented by (a), (b) and (c), respectively. The graph (d) represents the actions of the spring 22 as a result of the synthesis of the two graphs (b) and (c).

FIG. 8 shows that until a blow occurs, the cylindrical rotor 5 rotates in one direction, during which the force of the spring 22 is weak at the point indicated by (A). No substantial influences are given on the hammer member 13 and the cylindrical rotor 5. When blows occur on a bolt or a nut, the cylindrical rotor 5 rebounds, and simultaneously, the action of the spring 22 instantaneously becomes large. At the moment when the hammer member 13 is disengaged from the projection 7 of the cylindrical rotor 5 under the reaction of blows on the bolt (at the point (B)), the action of the spring 22 is still negligible. While the hammer member 13 passes through the guide groove 9 (at the point (C)), the force of the spring 22 becomes large, and the situation (A) is recovered in which the cylindrical rotor 5 is in free rotation.

What is claimed is:

1. An impact wrench comprising:

a casing;

driving means situated in said casing, a cylindrical rotor rotationally situated in said casing to be driven by said driving means, said rotor having an inner surface and engaging means situated on said inner surface of the rotor, an anvil rotationally situated in said cylindrical rotor and having a groove thereon located inside the cylindrical rotor to extend parallel to the axis of the rotor, a hammer pivotally disposed in the groove of the anvil and having a pair of side ridges, said hammer, when tilted relative to the anvil, allowing the rotor to freely rotate therealong and engaging the engaging means of the rotor when encountered, and means for providing tension to the hammer only when the hammer substantially engages the engaging means, said means for providing tension being actuated to urge the hammer to orient radially outwardly from the axis of the rotor to thereby allow the hammer to disengage from the engaging means when rotation of the rotor stops, said means for providing tension including shallow and deep cam surfaces radially outwardly extending from the inner surface of the rotor around the circumference of the rotor in a plane perpendicular to the axis of the rotor, said shallow cam surface being substantially located opposite the engaging means on the rotor with respect to the axis of the rotor and said deep cam surface being located at the rest of circumference of the rotor in that particular plane, and a tension device situated in said anvil between the hammer and one of the shallow and deep cam surface, said tension device having a pusher situated behind the hammer, a support to be contacted by one of the shallow and deep cam surfaces, and a spring situated between the pusher and the support to urge them away from each other so that when the support is located on the shallow cam surface, the pusher is pushed toward the hammer to orient the hammer radially outwardly of the cylindrical rotor.

2. An impact wrench according to claim 1, in which said pusher includes a pushing top at one end to contact with the hammer and a shank portion at the other end thereof, and said support includes a slot to slidably receive the shank portion of the pusher and a bottom to contact with one of the shallow and deep cam surfaces.

3. An impact wrench comprising a casing, driving means situated in said casing, a cylindrical rotor rotationally disposed in said casing to be driven by said driving means, said rotor including a cylindrical inner surface, a guide groove extending radially outwardly from the inner surface of the rotor and partially around the circumference of the rotor in a plane perpendicular to the axis of the rotor, a projection adjacent to said guide groove and radially inwardly extending from said cylindrical inner surface, said projection having partially round side portions at both sides thereof, and shallow and deep cam surfaces radially outwardly extending from the inner surface of the rotor around the circumference of the rotor in a plane perpendicular to the axis of the rotor, said shallow cam surface being substantially located opposite the projection with respect to the axis of the rotor and said deep cam surface being located at the rest of the circumference of the rotor in that particular plane, an anvil rotationally situated in said cylindrical rotor, said anvil having a groove thereon located inside said cylindrical rotor to extend parallel to the axis of the rotor, a head outside said cylindrical rotor for transmitting power from said driving means outwardly, and a bore perpendicular to the axis of the rotor and communicating with the groove, a hammer pivotally disposed in the groove of the anvil, said hammer having a pair of side ridges extending substantially the entire length of said hammer and a top projection between the side ridges so that when said hammer is tilted relative to the anvil, one of the side ridges and the top projection contact the inner surface of the cylindrical rotor to thereby allow the cylindrical rotor to rotate freely relative to the hammer, and when the tilted hammer engages one of the round side portions of the projection of the cylindrical rotor, the hammer transmits rotation of the cylindrical rotor to the anvil, and a tension device situated in the bore of the anvil between the hammer and one of the shallow and deep cam surfaces to urge the top projection of the hammer to orient radially outwardly of the cylindrical rotor so that when said top projection of the hammer is located in the guide groove, the tension device is also located on the shallow cam surface to thereby push the hammer outwardly, whereby said side ridges of the hammer pass freely over the projection of the cylindrical rotor to thereby allow the cylindrical rotor to rotate without rotating the anvil.

4. An impact wrench according to claim 3, in which said guide groove is located at an outer end of said cylindrical rotor, and the top projection is provided at an end of the hammer so that the top projection can pass through the guide groove.

5. An impact wrench comprising a casing, driving means situated in said casing, a cylindrical rotor rotationally disposed in said casing to be driven by said driving means, said rotor including a cylindrical inner surface, a guide groove extending radially outwardly from the inner surface of the rotor and partially around the circumference of the rotor in a plane perpendicular to the axis of the rotor said guide groove being located at an outer end of said cylindrical rotor, a projection adjacent to said guide groove and radially inwardly extending from said cylindrical inner surface, said projection having partially round side portions at both sides thereof, and shallow and deep cam surfaces radially outwardly extending from the inner surface of the rotor around the circumference of the rotor in a plane perpendicular to the axis of the rotor, said shallow cam surface being substantially located opposite the projection with respect to the axis of the rotor and said deep cam surface being located at the rest of the circumference of the rotor in that particular plane, an anvil rotationally situated in said cylindrical rotor, said anvil having a groove thereon located inside said cylindrical rotor to extend parallel to the axis of the rotor, a head outside said cylindrical rotor for transmitting power from said driving means outwardly, and a bore perpendicular to the axis of the rotor and communicating with the groove, a hammer pivotally disposed in the groove of the anvil, said hammer having a pair of side ridges extending substantially the entire length of said hammer and a top projection situated at one end of the hammer between the side ridges so that when said hammer is tilted relative to the anvil, one of the side ridges and the top projection contact the inner surface of the cylindrical rotor to thereby allow the cylindrical rotor to rotate freely relative to the hammer, and when the tilted hammer engages one of the round side portions of the projection of the cylindrical rotor, the hammer transmits rotation of the cylindrical rotor to the anvil, and a tension device situated in the bore of the anvil between the hammer and one of the shallow and deep cam surfaces to urge the top projection of the hammer to orient radially outwardly of the cylindrical rotor, said tension device including a pusher situated behind the hammer, a support to be contacted by one of the shallow and deep cam surfaces, and a spring situated between the pusher and the support to urge them away from each other so that when the support is located on the shallow cam surface, the pusher is pushed toward the hammer to orient the top projection radially outwardly of the cylindrical rotor to allow the top projection to pass through the guide groove and to allow said side ridges to pass freely over the projection of the cylindrical rotor to thereby allow the cylindrical rotor to rotate without rotating the anvil.

6. An impact wrench according to claim 5 in which said pusher includes a pushing top at one end to contact with the hammer and a shank portion at the other end thereof, and said support includes a slot to slidably receive the shank portion of the pusher and a bottom to contact with one of the shallow and deep cam surfaces.

* * * * *